US006692102B2

(12) United States Patent
Hendricks

(10) Patent No.: US 6,692,102 B2
(45) Date of Patent: Feb. 17, 2004

(54) PRINTHEAD-ASSEMBLY-TO-SUPPORT-STRUCTURE Z-AXIS DATUMING IN A PRINTING DEVICE

(75) Inventor: Jeffrey T. Hendricks, Camas, WA (US)

(73) Assignee: Hewlett-Packard Development Company, LP, Houston, TX (US)

( * ) Notice: Subject to any disclaimer, the term of this patent is extended or adjusted under 35 U.S.C. 154(b) by 0 days.

(21) Appl. No.: 10/198,291

(22) Filed: Jul. 17, 2002

(65) Prior Publication Data

US 2004/0012652 A1 Jan. 22, 2004

(51) Int. Cl.[7] ..... B41J 23/00
(52) U.S. Cl. ..... 347/37
(58) Field of Search ..... 347/8, 37, 160, 347/49; 400/120.16, 120.17

(56) References Cited

U.S. PATENT DOCUMENTS 4,530,611 A * 7/1985 Borcenk et al. ..... 400/120.16
5,002,497 A 3/1991 Plocek et al. ..... 439/248
5,071,374 A 12/1991 Plocek et al. ..... 439/752
5,199,900 A 4/1993 Hayes, Sr. ..... 439/557
5,617,128 A 4/1997 Thoman et al. ..... 347/87
5,646,665 A 7/1997 Swanson et al. ..... 347/87
6,106,174 A 8/2000 Shen ..... 400/583
6,220,691 B1 4/2001 Martin et al. ..... 347/33

FOREIGN PATENT DOCUMENTS

JP 04251584 * 4/1994 ..... 347/8

* cited by examiner

*Primary Examiner*—Thinh Nguyen
*Assistant Examiner*—Julian D. Huffman

(57) ABSTRACT

The present invention involves a printing device having a frame which defines therein X, Y, and Z operative, orthogonal axes, plural-site, Z-axis datuming structure operatively interposed a printhead assembly and a carriage supporting that assembly within the device, the Z-axis datuming structure, comprising first and second datuming sites spaced generally in an X-axis direction, and a third datuming site spaced from both the first and second sites in a Y-axis direction, and from at least one of the first and second sites in an X-axis direction.

5 Claims, 3 Drawing Sheets

PRINTHEAD-ASSEMBLY-TO-SUPPORT-STRUCTURE Z-AXIS DATUMING IN A PRINTING DEVICE

BACKGROUND OF THE INVENTION

In printing devices and systems, such as in inkjet printing devices and systems, one consideration involves accurate alignment of the printhead assembly nozzles with respect to the X, Y and Z orthogonal reference axes (typically, right-handed) that are defined operatively within the printer (printing device) by the printer's frame or chassis. Typically, this alignment is one which focuses considerably upon printhead assembly alignment with the scan-axis positioning guide, typically a precision-ground cylindrical rod, often referred to as a carriage rail, along which the support-structure carriage, which carries a printhead assembly, moves back and forth during a printing operation. Such printhead assembly alignment, both translational and rotational, is designed with respect to all three reference axes.

For the purpose of illustration herein, datuming is described in conjunction with a printer'printhead assembly, and the supporting structure provided therefor in the form of a carriage. While another type of direct support structure may specifically be employed, illustration herein with a carriage is intended to represent all other such structures. Because certain details of construction do not form parts of the illustrated embodiments of the present invention, components in the datuming environment of the embodiments of the invention are pictured herein principally in block/schematic forms.

SUMMARY OF THE INVENTION

The present invention involves a printing device having a frame which defines therein X, Y, and Z operative, orthogonal axes, plural-site, Z-axis datuming structure operatively interposed a printhead assembly and a carriage supporting that assembly within the device, the Z-axis datuming structure, comprising first and second datuming sites spaced generally in an X-axis direction, and a third datuming site spaced from both the first and second sites in a Y-axis direction, and from at least one of the first and second sites in an X-axis direction.

BRIEF DESCRIPTION OF THE DRAWINGS

FIG. 2 is taken generally along line 2—2 in FIG. 1.

DETAILED DESCRIPTION

Figure 1:
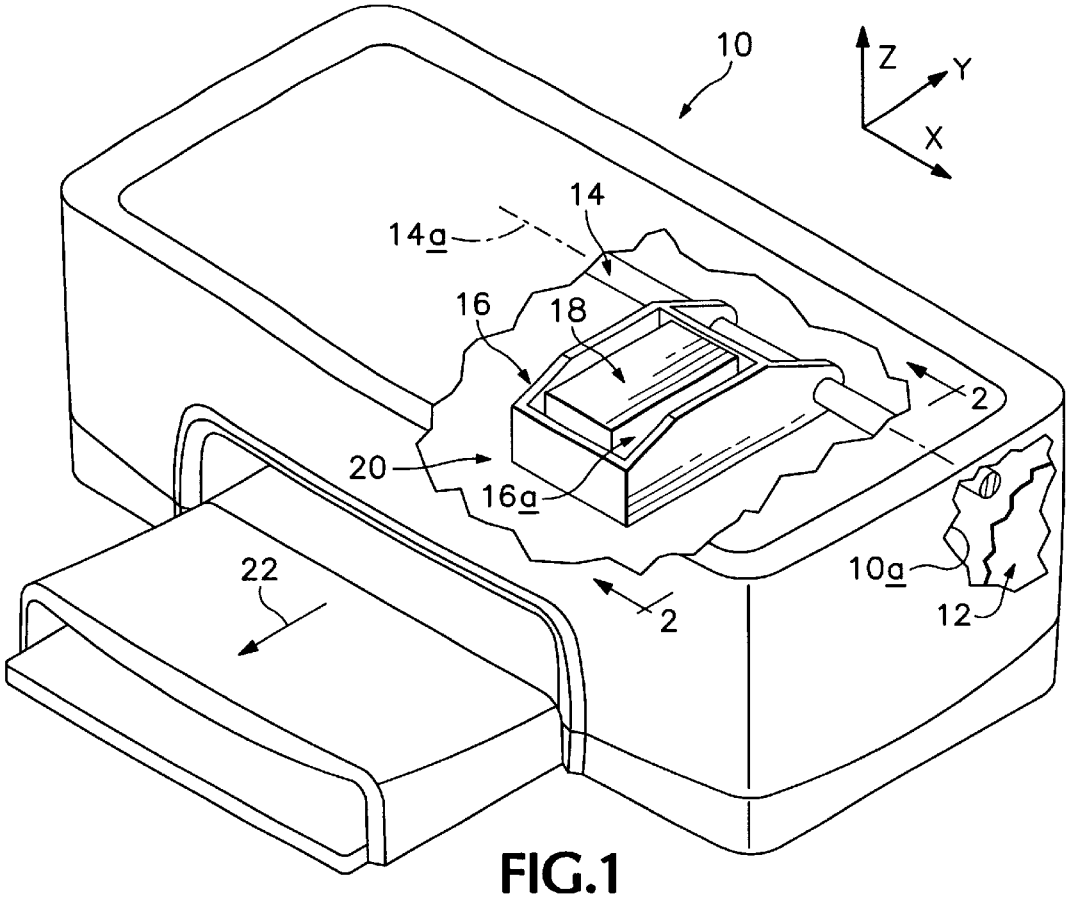
FIG. 1 is a top, simplified, isometric view illustrating portions of an inkjet printer which employs plural-site, Z-axis structure that performs in accordance with the methodology of, and which is made in accordance with, an embodiment of the present invention.

Turning attention now to the drawings, and referring first to FIGS. 1–4, indicated generally at 10 in FIG. 1 is an inkjet printer (printing device) which incorporates an embodiment of, and which performs in accordance with one manner of practicing, the present invention. It should be understood that while printer 10, in a simplified manner, is illustrated as a stand-alone inkjet printer, embodiments of the present invention may be employed in a variety of printing devices, including copiers, facsimile machines, etc.

Included in printer 10, and indicated just fragmentarily at 12 (through a breakaway opening 10*a* which is provided in the outer casing of printer 10) is the printer frame which, for printer 10, may be used to define three operative, orthogonal axes shown at X, Y and Z in FIG. 1. These three axes act as reference axes in the printer, with the depicted axis X extending from side-to-side (laterally), axis Y extending in the fore-and-aft direction in the printer, and axis Z extending substantially up-and-down (or vertically) through, and with respect to, the printer.

Suitably mounted on an elongate cylindrical rail 14, which is known as a carriage rail in printer 10, and which includes a long axis 14*a* that substantially parallels the X axis, is a laterally reciprocable carriage 16. Opposite ends of rail 14, one of which ends is shown broken away (through opening 10*a*) near the right side of FIG. 1, are suitably anchored to frame 12. Carriage 16, through datuming structure, one embodiment of which is shown incorporated in printer 10, supports a printhead assembly 18 shown in simple block form in all of the figures herein. As will be described below, this datuming structure may be configured to oppose movement of the printhead assembly relative to the carriage, both translational ($\Delta X$, $\Delta Y$, $\Delta Z$) and rotational ($\theta X$, $\theta Y$, $\theta Z$).

During a printing operation in printer 10, under the control of appropriate motor structure (not shown), carriage 16 typically transports printhead assembly 18 back and forth (on rail 14) generally parallel to the X axis over a printing zone (shown generally at 20) which underlies the carriage and printhead assembly. In the depicted embodiment, zone 20 lies overhead traveling print media, such as paper, which advances through printing zone 20 generally in the direction of arrow 22. Arrow 22 substantially parallels the Y axis, pointing in what may be referred to as a negative Y direction, and is shown on the front side of printer 10 in FIG. 1.

In the particular printer now being described, printhead assembly 18 takes the form of a monolithic assembly which is intended to be stably mounted and aligned on and with respect to a suitable receiving space, shown generally at 16*a* in the figures, within carriage 16.

As was mentioned just above, and as is mentioned again here now, a number of components in printer 10, such as carriage 16, printhead assembly 18, and various datuming and biasing sites (and associated structures) are all illustrated in block and schematic form inasmuch as their respective exact constructions can take any one of a number of different, specific forms. Thus these components are shown herein only in schematic form in order to bring out the structural distribution and the operational elegance, simplicity and sophistication of the disclosed embodiments of the present invention. Such datuming and biasing sites may be referred to, more generally, as reaction sites.

Figure 2:
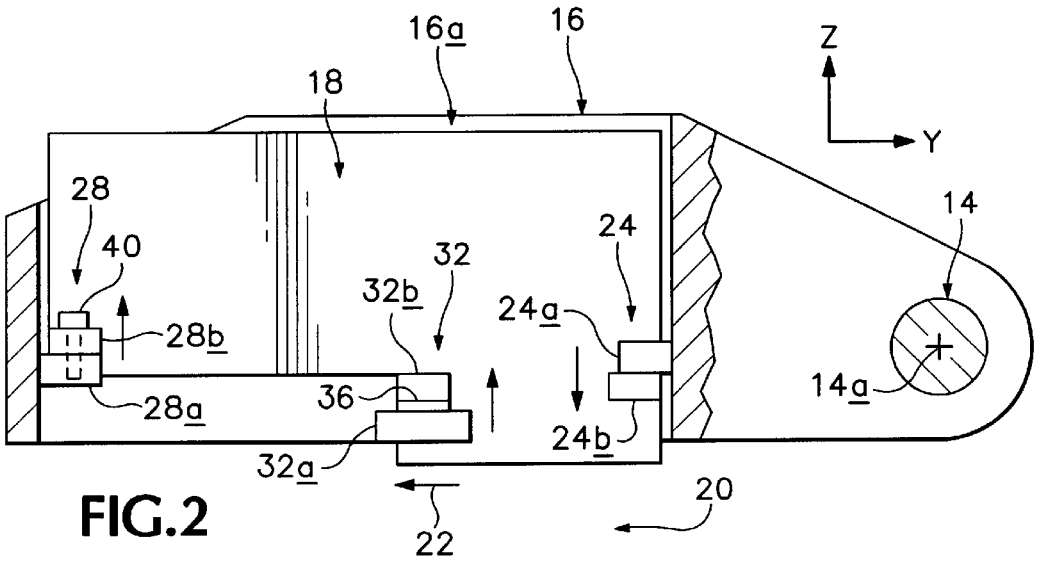
FIG. 2 is an enlarged, fragmentary, isolated view of portions of a carriage, of a printhead assembly, and of portions of plural-site, Z-axis datuming structure, including compliant biasing structure, constructed, and performing, in accordance with an embodiment of the present invention.
Figure 3:
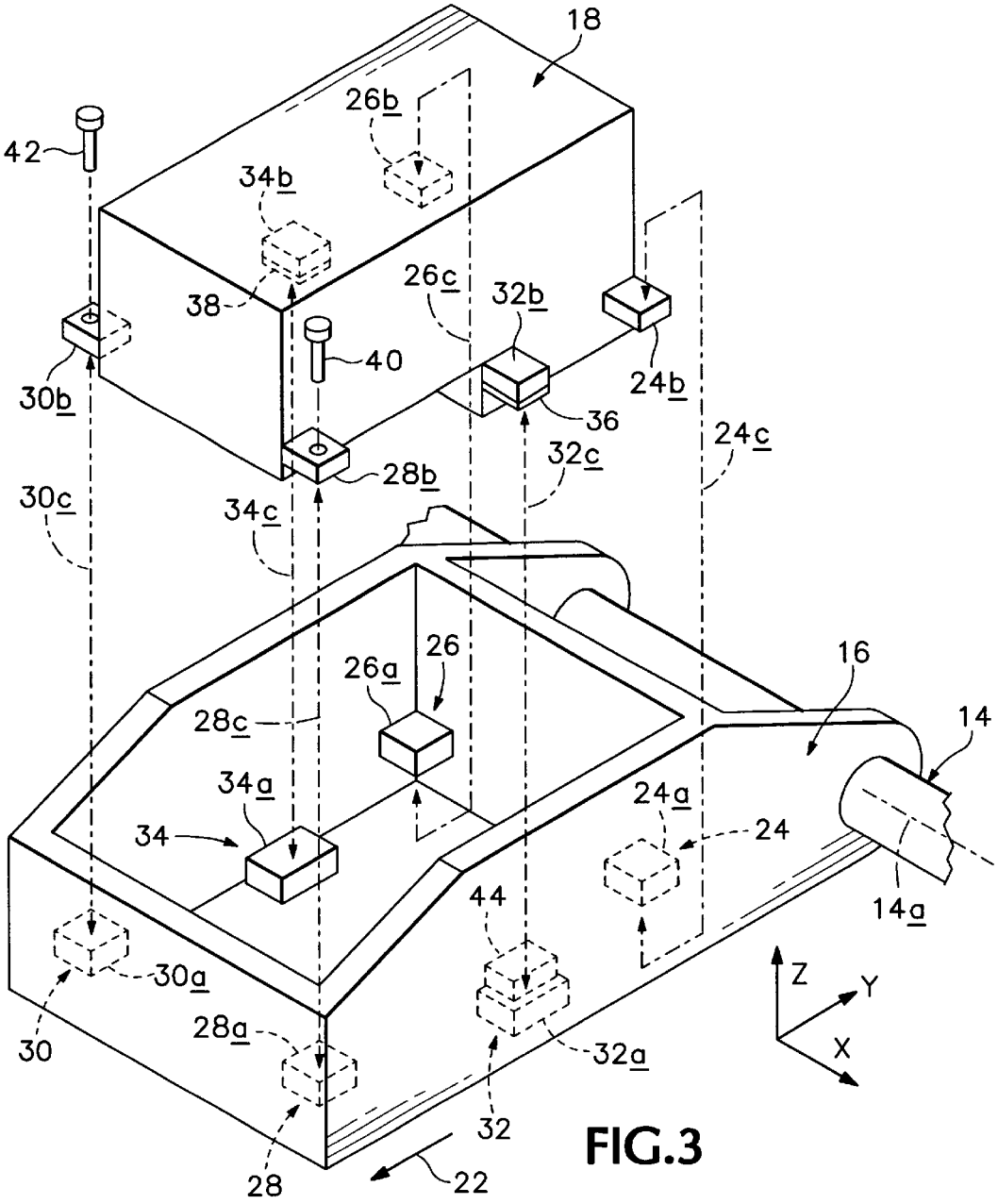
FIG. 3 is a fragmentary, top, isometric view, on about the same scale employed in FIG. 2, illustrating an exploded view of components shown in FIG. 2.
Figure 4:
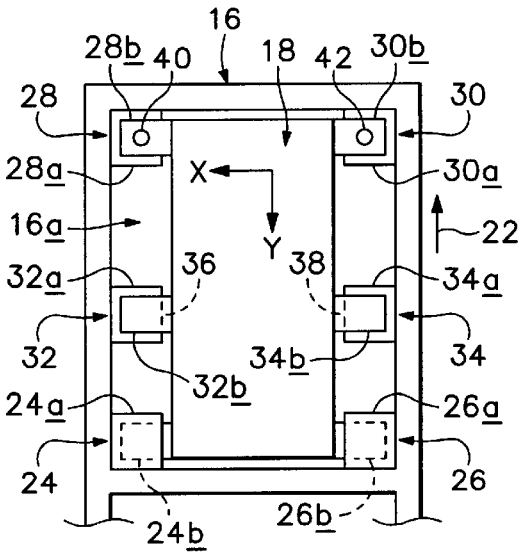
FIG. 4 is a fragmentary, simplified, smaller-scale, top-plan view of the components pictured in FIGS. 2 and 3.

Accordingly, in the embodiment of the invention which is depicted in printer 10, and as is shown in FIGS. 2–4, what is incorporated therein takes the form of plural-site, Z-axis datuming structure including six reaction sites shown at 24, 26, 28, 30, 32, 34. Sites 24 and 26, which are also referred to herein as first and second datuming sites, are shown located near the rear (positive Y) end of the printhead assembly, sites 28 and 30, which are also referred to herein as third and fourth datuming sites, are shown located near the front (negative Y) end of the printhead assembly, and sites 32 and 34, which function herein as compliant, Z-axis biasing sites, are shown located (in a Y-axis sense), intermediate the four datuming sites. As can be seen especially in FIGS. 3 and 4, sites 24 and 26, 28 and 30, and 32 and 34, are shown laterally spaced (in the X axis), and disposed generally with bilateral symmetry relative to the opposite sides of printhead assembly 18. As can also be seen especially well in FIGS. 3 and 4, sites 24, 26, 28, 30, 32, 34 generally lie around the perimeter of the Z-axis "footprint" of printhead assembly 18.

Figure 5:
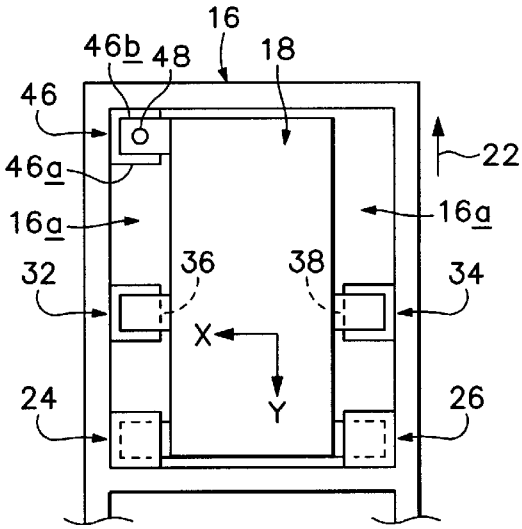
FIG. 5 illustrates modified Z-axis datuming structure provided adjacent a front end of a printhead assembly in accordance with another embodiment of the present invention.
Figure 6:
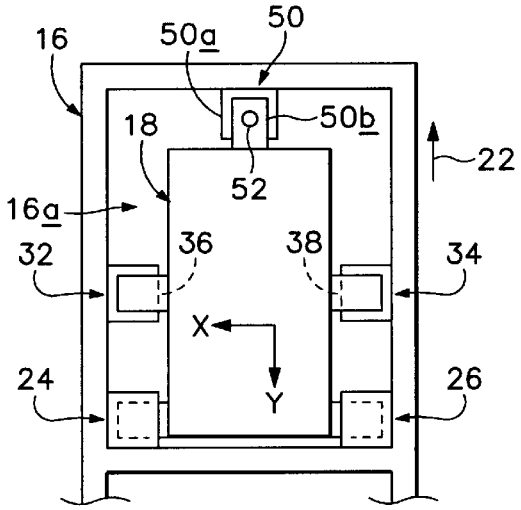
FIG. 6 illustrates another embodiment of the invention which is similar to the embodiment shown in FIG. 4, except that the structure of FIG. 6 employs another form of Z-axis datuming adjacent a front end of a printhead assembly.

In FIG. 4, it should be pointed out, the X and the Y axes are shown lying in the plane of the figure. The Z axis thus extends normal to the plane of FIG. 4, and in FIG. 4, the viewer is looking down on the datumed interconnection which exists between carriage 16 and printhead assembly 18. It might be pointed out at this juncture, that the points of view presented in FIGS. 5 and 6, are the same as that presented in FIG. 4.

From the perspective of carriage 16, sites 24, 26, 28, 30, 32, 34 include carriage-connected platforms, such as those shown at 24*a*, 26*a*, 28*a*, 30*a*, and 32*a* and 34*a*. In the particular embodiment now being described, these six platforms are disposed generally within previously-mentioned receiving space 16*a* within the body of carriage 16, as shown.

Also included in the datuming structure, typically as individual structures which cooperate with the six platforms just described that are attached to the body in carriage 16, are six outwardly projecting, printhead-assembly-anchored platforms 24*b*, 26*b*, 28*b*, 30*b*, 32*b*, 34*b*. These six platforms are disposed generally in Z-axis alignment with previously-mentioned platforms 24*a*, 26*a*, 28*a*, 30*a*, 32*a*, 34*a*, respectively. Lines of Z-axis reaction forces (Z-axis alignment) on printhead assembly 18, via sites 24, 26, 28, 30, 32, 34, are shown, respectively, at 24*c*, 26*c* (downward), 28*c*, 30*c* (upward), and 32*c*, 34*c* (upward) in FIG. 3. Shown at 36, 38 are two appropriately resilient, compliant pads which maybe attached to the undersides of platforms 32*b*, 34*b*, respectively, as shown.

As was just mentioned above, the interactions between platforms 24*a*–24*b*, 26*a*–26*b*, 28*a*–28*b*, 30*a*–30*b*, 32*a*–32*b* and 34*a*–34*b*, produce Z-axis reaction forces between the carriage and the printhead assembly. Downwardly-directed (negative Z), Z-axis reaction forces may be applied through platforms 24*b*, 26*b* to the printhead assembly. Upwardly-directed (positive Z), Z-axis reaction forces may be applied through platforms 28*b*, 30*b* to the front of the printhead assembly. Compliant, upwardly-directed, Z-axis reaction forces may be applied through pads 36, 38 and platforms 32*b*, 34*b* somewhat centrally (in the front-to-rear Y-axis sense) between platforms 24*b*, 26*b* which are shown toward the rear (positive Y) of the printhead assembly, and platforms 28*b*, 30*b* which are shown toward the front (negative Y) of the printhead assembly.

The printhead assembly and the carriage may be assembled by directing the printhead assembly into the carriage at an angle as the printhead assembly is installed in the datuming structural arrangement. These two structures are anchored to one another herein through the very simple structural arrangement of two anchoring devices such as fasteners, shown at 40, 42 in FIGS. 2–4. Fasteners 40, 42 each constitute an adjustable anchoring device herein. These fasteners may extend through suitable accommodating bores provided in platforms 28*b*, 30*b*, respectively, and have threaded lower ends that are screwed into suitable threaded accommodating bores (not shown) provided in platforms 28*a*, 30*a*, respectively. Although particular fastening devices are shown, it will be appreciated that virtually any anchoring arrangement may be employed. Tightening of fasteners 40, 42 causes a certain amount of compression to develop in compliant pads 36, 38, and this action causes the printhead assembly to be securely, stably and precisely datumed, in a Z-axis sense, on and with respect to carriage 16.

While the embodiment which has just been described includes two compliant pads 36, 38, which are nominally attached to the undersides of platforms 32*b*, 34*b*, respectively, like compliant pads could be attached to the upper surfaces of platforms 32*a*, 34*a*, respectively, instead. With reference specifically now made to FIG. 3, a single, such, alternatively attached pad is shown for illustration purposes in dashed lines at 44, on top of platform 32*a*. Such a mounting for compliant pads forms an alternative structure for a compliant element of datuming structure built in accordance with certain embodiments of the present invention.

As was mentioned above with respect to the descriptions of FIGS. 5 and 6 of the drawings, these two additional drawing views illustrate two other modified forms of the datuming structure which differ in certain respects in comparison to the embodiment specifically pictured in FIGS. 2–4. In each of FIGS. 5 and 6, reaction sites and structures therein which are substantially identical to those in location and construction with respect to what has already been described with respect to FIGS. 2, 3 and 4, are either not specifically pointed out in detail, or are pointed out utilizing the same respective structural reference numerals. Where structural differences exist, new reference numerals are employed.

Thus, and turning now to the embodiment illustrated in FIG. 5, only a single Z-axis datuming site is provided adjacent the front (negative Y) end of the printhead assembly. Such a site, a laterally off-center site, is shown generally at 46 in FIG. 5. Site 46, in the embodiment of FIG. 5 herein, generally occupies the same position as previously-described site 28 in the embodiment of FIGS. 2–4. A datuming site, such as site 30 pictured in FIG. 4, is omitted from the embodiment of FIG. 5. Site 46 may be defined by a platform 46*a*, which is a counterpart to previously-described platform 28*a*, a platform 46*b*, which is a counterpart to previously-described platform 28*b*, and an anchoring fastener 48, which is a counterpart to previously-described anchoring fastener 40. A Z-axis line of upward (positive Z) datuming reaction force (not shown) acts, via site 46, on printhead assembly 18 like that which acts along previously mentioned force line 28*c*.

FIG. 6 illustrates an arrangement which, with the exception of the construction of a front (negative Y) end, Z-axis datuming site for and between carriage 16 and printhead assembly 18, is otherwise substantially the same as the arrangement pictured in the embodiment of FIGS. 2, 3 and 4. In the arrangement of FIG. 6, a single, laterally-central datuming site 50 is employed, including a platform 50*a* which is anchored, within space 16*a*, on the body of carriage 16, a platform 50*b* which is appropriately anchored to the body of printhead assembly 18, and an anchoring fastener 52 which acts and is structured like the previously-described anchoring fasteners herein. A Z-axis line of upward datuming reaction force (not shown) acts, via site 50, on printhead assembly 18 like the force which acts along previously mentioned line 28*c*, except that it is generally centered laterally relative to the X-axis dimension of the printhead assembly.

Thus there has been illustrated and described herein in several embodiments, a novel Z-axis, plural-site datuming structure and methodology constructed and operating in accordance with an embodiment of the present invention. Such embodiments all of the important features of simplicity, stability, accuracy, and also great ease of incorporation into a wide variety of different printhead assemblies/carriages, etc. in printing devices such as in printer 10. While a number of different embodiments and modifications of the structural arrangement of the present invention have been illustrated and described herein, all share in common the presence, in a printing device which has a frame that defines X, Y and Z orthogonal reference axes, datuming structure of the type just generally mentioned which includes first and second datuming sites that are spaced generally in an X direction, and which are interposed operatively between a printhead assembly and a supporting structure, such as a carriage, and a third datuming site which is spaced in a Y-axis direction from each of the first-mentioned two datuming sites, and is also spaced from at least one of those two sites in an X-axis direction. With regard to this arrangement that characterizes various embodiments of the invention, the methodology implemented thereby includes furnishing first and second, laterally-spaced, Z-axis datuming reaction forces against the printhead assembly, and additionally, furnishing a third, Z-axis datuming reaction force against the printhead assembly at a location which is spaced in a Y-axis direction from the points of application of the first and second such reaction forces, which location is also spaced in an X-axis direction relative to at least one of the first two mentioned datum reaction forces.

In various embodiments of the invention, the front and rear datuming sites which are provided intermediate a supporting structure, such as a carriage, and a printhead assembly have different distributions relative to the lateral perimeter of the printhead assembly. In certain embodiments of the invention, reaction forces furnished adjacent the rear of the printhead assembly are downwardly directed reaction forces, while that or those adjacent the front of the printhead assembly is/are upwardly directed.

Intermediate the front and rear datuming sites, in certain embodiments of the invention, there are provided biasing sites which furnish upwardly directed reaction forces against a printhead assembly, with these forces extending through resilient compliance structure which operates in compression intermediate the printhead assembly and its supporting structure, such as carriage structure.

While the invention has been particularly shown and described with reference to the foregoing embodiments, and the associated methodology(ies) those skilled in the art will understand that many variations may be made therein without departing from the spirit and scope of the invention as defined in the following claims.

What is claimed is:

1. In a printing device having a frame which defines therein X, Y, and Z operative, orthogonal axes, plural-site, Z-axis datuming structure operatively interposed between a printhead assembly and a carriage supporting that assembly within the device, the Z-axis datuming structure comprising:

first and second, spaced reaction sites, located toward a positive Y end of the printhead assembly, and furnishing a negative Z-direction reaction force against the printhead assembly, third and fourth, spaced reaction sites, located toward a negative Y end of the printhead assembly, and furnishing a positive Z-direction reaction force against the printhead assembly, and fifth and sixth, spaced reaction sites, located intermediate the first and second sites and the third and fourth sites, and furnishing a compressive, compliant, positive Z-direction reaction force against the printhead assembly.

2. The datuming structure of claim 1, wherein the respective first and second, third and fourth, and fifth and sixth, sites are disposed generally with bilaterally symmetry relative to the printhead assembly.

3. In a printer having a frame which defines therein X, Y, and Z operative, orthogonal axes, plural-site, Z-axis datuming structure operatively interposed between a printhead assembly and a carriage supporting that assembly within the printer, the Z-axis datuming structure comprising:

first and second, spaced printhead-to-carriage datuming means, located toward a first end of the printhead assembly, and furnishing a negative Z-direction reaction force against the printhead assemblies, third and fourth, spaced printhead-to-carriage datuming means, located toward a second opposite end of the printhead assembly, and furnishing a positive Z-direction reaction force against the printhead assembly, and biasing means located intermediate the first and second, and the third and fourth, sites, and furnishing a compressive, compliant, positive Z-direction reaction force against the printhead assembly.

4. In a printer having a frame which defines therein X, Y, and Z operative, orthogonal axes, plural-site, Z-axis datuming structure operatively interposed between a printhead assembly and a carriage supporting that assembly within the printer, the Z-axis datuming structure comprising:

first and second, spaced datuming means, located toward a first end of the printhead assembly, and furnishing a negative Z-direction reaction force against the printhead assemblies, third and fourth, spaced datuming means, located toward a second opposite end of the printhead assembly, and furnishing a positive Z-direction reaction force against the printhead assembly, and biasing means located intermediate the first and second, and the third and fourth, sites, and furnishing a compressive, compliant, positive Z-direction reaction force against the printhead assembly;

wherein said first and second, and third and fourth, datuming means are disposed generally with bilaterally symmetry relative to said printhead assembly.

5. A method of furnishing plural-site, Z-axis datuming between a printhead assembly and a carriage in a printing device having a frame which defines, in the device, X, Y, and Z, operative, orthogonal axes, the method comprising:

furnishing first and second, spaced, negative Z-axis datuming reaction forces, which are spaced in a Y-axis direction, against and toward a first end of the printhead assembly, furnishing third and fourth, spaced, positive Z-axis datuming reaction forces against and toward a second opposite end of the printhead assembly, and furnishing compliant positive Z-axis biasing reaction forces against the printhead assembly intermediate, in a Y-axis sense, the points of application, respectively, of the first and second such forces, and the third and fourth such forces.

* * * * *